US011753869B2

(12) United States Patent
Salvarezza

(10) Patent No.: US 11,753,869 B2
(45) Date of Patent: Sep. 12, 2023

(54) KNOTLESS SECURITY DEVICE

(71) Applicant: Coast Marine & Industrial Supply, San Francisco, CA (US)

(72) Inventor: Robert M Salvarezza, Hillsborough, CA (US)

( * ) Notice: Subject to any disclaimer, the term of this patent is extended or adjusted under 35 U.S.C. 154(b) by 824 days.

(21) Appl. No.: 16/846,329

(22) Filed: Apr. 11, 2020

(65) Prior Publication Data

US 2021/0317704 A1 Oct. 14, 2021

(51) Int. Cl.

| | |
|---|---|
| ***E06C 7/18*** | (2006.01) |
| ***E06C 7/50*** | (2006.01) |
| ***B63B 27/04*** | (2006.01) |
| ***E06C 7/14*** | (2006.01) |
| *B63B 27/14* | (2006.01) |

(52) U.S. Cl.

CPC ..... *E06C 7/188* (2013.01); *E06C 7/14* (2013.01); *B63B 27/146* (2013.01); *E06C 7/505* (2013.01)

(58) Field of Classification Search

CPC . E06C 7/188; E06C 7/14; E06C 7/505; E06C 1/56; E06C 9/14; B63B 27/146

See application file for complete search history.

(56) References Cited

U.S. PATENT DOCUMENTS 4,843,848 A 7/1989 Igelmund
5,529,145 A * 6/1996 Allred ..... E06C 7/188 182/206
5,727,833 A 3/1998 Coe
9,951,558 B2 4/2018 Maragliano
10,415,312 B1 9/2019 Conroy
2019/0048663 A1 2/2019 Kay et al.

OTHER PUBLICATIONS

Dbropes on-line catalog, published on or before Apr. 10, 2020; https://dbropes.com "mooring line with heavy duty thimble".
Dbropes on-line catalog, published on or before Apr. 10, 2020, https://dbropes.com "three strand mooring pendant".
West Marine on-line catalog, published on or before Apr. 10, 2020, www.westmarine.com "New England Ropes—three strand nylon mooring pendants".
West Marine on-line catalog, published on or before Apr. 10, 2020, www.westmarine.com "New England Ropes—polyester/nylon double-braid mooring pendants".
West Marine on-line catalog, published on or before Apr. 10, 2020; www.westmarine.com "Greenfield Products—anchor buddy mooring lines".

(Continued)

*Primary Examiner* — Anthony D Wiest

(57) ABSTRACT

A self-contained knotless security device and method for adjustably securing rope-style pilot ladders and debarkation ladders from any rung to ship deck lashing points, the device not relying on additional mechanical fittings or knot-tying skills. The device comprising a section of multi-strand polyester rope comprising an integrated polyolefin core and having a ship end and a ladder end, the ship end comprising a rugged, wear and corrosion-resistant thimble eye or shackle and the ladder end comprising a flexible long soft eye on the other end. The method comprising encircling ladder suspension members with the device and securing the device to the ship deck lashing point. Alternate polyolefin core construction provides tailored performance characteristics.

2 Claims, 6 Drawing Sheets

(56) References Cited

OTHER PUBLICATIONS

Sampson Rope on-line catalog, published on or before Apr. 10, 2020, https://sampsonrope.com/catalog/tug-catalog, p. 22 "tug maneuvering line pendants".
American Safety on-line catalog, published on or before Apr. 10, 2020, (https://www.americansafety.com, search "S0190L0048", "transformer sling".
Keeper Products on-line catalog, published on or before Apr. 10, 2020, www.keeperproducts.com, search "lift sling", "lift sling".
CajunRope.Com on-line catalog, published on or before Apr. 10, 2020, www.cajunrope.com, "Mooring Lines", "mooring lines".
Dbropes, https://dbropes.com "mooring lines", "mooring pendants".
www.westmarine.com "Three-Strand Nylon Mooring Pendants".
www.westmarine.com "Polyester/Nylon Double-Brain Mooring Pentants".
www.westmarine.com "Anchor Buddy Mooring Lines".
https://sampsonrope.com/catalog/tug-catalog, p. 22 "Tug Maneuvering Line Pendants".

* cited by examiner

KNOTLESS SECURITY DEVICE

TECHNICAL FIELD OF THE INVENTION

This application pertains to a safety rope for adjustably securing rope-style pilot ladders and debarkation ladders to ships.

BACKGROUND OF THE INVENTION

Debarkation ladders and pilot ladders are mandatary marine safety equipment on every ship. A debarkation ladder is used for disembarkation, while a pilot ladder is used for the pilot and crew's getting in and out of the vessel. In general the pilot ladder has spreader for ladder stability during unfavorable conditions, which is different from a debarkation ladder.

Typically, pilot ladders are constructed of a series of steps attached on each end at equal spacings by suspension members, also referred to as side ropes. The two suspension members, each consisting of two laid or twisted ropes in parallel, run the length of the ladder. The top end of one suspension member on each side of the ladder must extend at least 3 m (10 ft.) beyond the top ladder step; and the top ends of the other suspension members must be just above the top step and must have an eye splice or thimble large enough to fit two passes of a suspension member. The top end of each suspension member that does not have an eye splice or thimble must be served or treated to prevent fraying. The eye splice or thimble terminated suspension member, or lashing, serves as a tie-off element for the first 3 m (10 ft.) suspension member on its respective side. There are also various additional common components that manufacturers of pilot ladders use in assembling the completed ladders.

The U.S. Coast Guard and U.S. Navy define the above construction standards, as well as material, performance, testing and marking standards for pilot ladders in the U.S. Code of Federal Regulations. For example, steps or rungs may be made of a wood or a rubber or resilient plastic molded construction, and each suspension member must be mildew-resistant manila rope or a polyester rope with a polypropylene core of a color that contrasts with the polyester rope in order to provide a visual indication of excessive wear. Each suspension member must have a breaking strength of not less than 24 kN (5,400 lb.) and a nominal circumference of not less than 60 mm (2¼ in.). Ladders must also pass tests involving static loads. Additional standards exist for various materials, treatment, and performance requirements.

The U.S. Code of Federal Regulations does provide for the approval of alternatives when superior designs and materials are developed that improve the performance of pilot ladders. A pilot ladder that does not meet the specified materials, construction, or performance requirements may be approved provided that the application and any approval tests prescribed in place of or in addition to the approval tests required show that the alternative materials, construction, or performance is at least as effective as that specified by the requirements. Different production tests may be prescribed if the tests required are not appropriate for the alternative ladder configuration.

The applicant has already obtained approval for, and has been selling for several years, pilot ladders with suspension members having a substituted polyolefin core specifically integrated within each strand of the twisted polyester rope in place of a polyester rope with a polypropylene core. The substituted core not only satisfies the contrasting color requirement, but also provides for increased strength, durability and stretch resistance while maintaining flexibility, which importantly leads to an easier to handle pilot ladder. The result is approved pilot ladders that exhibit performance properties typically requiring larger, bulkier, harder to handle suspension members.

For example, the suspension member rope having the substituted polyolefin core has an increased breaking strength of over 30% compared to its polypropylene-cored counterpart. To achieve this performance, the suspension members of a manila or polyester rope pilot ladder would have to be of a significantly larger diameter, and therefore, make the pilot ladder more difficult to deploy and store. The resulting pilot ladder is widely recognized as being one of the strongest and easiest to handle pilot ladders in the industry, characteristics highly desirable in pilot ladders.

Similarly, in the commercial and industrial settings, pilot ladders are considered a part of the ship's safety equipment and therefore subject to the International Safety Management Code. Inspections are made within the scope of surveys concerning the Passenger Ship Safety Certificate or the Cargo Ship Safety Equipment Certificate according to The International Convention for the Safety of Life at Sea (SOLAS) international maritime treaty, which sets minimum safety standards in the construction, equipment and operation of merchant ships. Flag States are legally required to consider pilot ladders and their associated items of equipment on a regular basis during mandatory SOLAS inspections. It is imperative that the pilot ladder certificates, periodic inspection reports and records are maintained on board and detail the actual condition of the pilot ladders. The verification of these records are subject to inclusion in shore side internal audits.

Equally important to the construction of pilot ladders is how they are secured to a ship when in use. The proper way to secure a pilot ladder is by threading the rope lashings through approved strong lashing points on deck and then securely fastening the lashings back to their respected paired lashing, which are a part of the ladder suspension members. The lashing point on deck must be near the ship's side for exclusive service, with no other items connected.

Improperly secured debarkation and pilot ladders put lives at risk. On a daily basis, pilots worldwide are not only confronted with non-compliant pilot ladders which are dangerously unsafe, but additionally, are improperly secured without due regard to the safety of the pilot's life. In fact, the International Maritime Pilots' Association (IMPA) Safety Campaign 2015 revealed that 59% (63 out of a total of 107 defects) of non-compliant ladders were not secured properly. This stems from a number of reasons including lack of knowledge of regulations, inadequate training and incompetence, complacency, and other reasons.

Examples of not uncommon situations occur where the pilot ladder obtained is not exactly sized for the ship. In addition, vessel height may change due to displacement when the vessel is fully loaded or empty. Thus, there are conditions when the full length of the ladder cannot be used and allowing the extra length to float uncontrollably in the water is not desired nor safe. As these ladders are not height adjustable, pilots are faced with shortening a ladder, thus further complicating the proper securing of the ladder to the ship.

In the case of tying off a pilot ladder using other than the integrated lashings, as may be needed when shortening a ladder for instance, other ropes must be found. Unfortunately, ropes available on the ship may not adhere to the same weight bearing and other requirements of the pilot ladder suspension members and lashings, thus running the risk of creating failure points for the secured pilot ladders.

Furthermore, even if suitably specified tie-off ropes are available, in-field or at sea splices depend upon a properly skilled technician taking the appropriate amount of time, considering the equipment at hand, and following a detailed procedure to affect a safe ladder tie-off. In the case of a lower deck condition, the tie-off or stopper ropes must be adequately secured to the ladder at the deck level using the tie-off ropes in place of the ladder lashings in order to rig the ladder firmly to the deck lashing point. This requires highly skilled personnel that possess the expertise to tie off the ropes according to accepted methods. Not all personnel possess this level of skill, and therefore, may be putting themselves and others at extreme at unnecessary risk. This presents a high-risk vulnerability with potential to result in human injuries and death.

While various slings, chokers, tethers and mooring lines might be seen as potential solutions for securing pilot ladders to ships, this is not necessarily the case for several reasons. Given that these alternative devices essentially become part of the pilot ladder by replacing the pilot ladder lashings, prudent deployment would dictate that these alternative devices meet the pilot ladder requirements set forth in both U.S. Code of Federal Regulations 46 CFR 163.003 and International Standard ISO 799 Third edition Ships and Marine Technology—Pilot Ladders, both incorporated herein by reference, otherwise these alternative devices would not be approved for such use. These alternative device designs lack features that provide the mandated and desired field performance characteristics such as strength, configuration, friction tolerance, environmental resilience and soft touch in a single apparatus for quickly and easily securing pilot ladders. The instant invention enables quick, easy and secure pilot ladder positioning, delivering the desired performance characteristics using a single apparatus not dependent upon separate appliances, while also mitigating the human risk associated with deployment, thus effecting a safe and compliant deployment of a highly important piece of equipment in an open sea environment.

It is therefore an objective of the instant invention to provide a compliant, safe, easily and quickly deployed apparatus for securing pilot and debarkation ladders free of additional mechanical fittings or knot-tying.

It is also an objective of the instant invention to provide a compliant, safe, easily and quickly deployed apparatus for securing pilot and debarkation ladders from any rung position to ship deck lashing points.

It is also an objective of the instant invention to provide a compliant, safe, easily and quickly deployed apparatus for redundantly securing pilot and debarkation ladders to ship deck lashing points.

It is also an objective of the instant invention to provide a compliant safe, easily and quickly deployed apparatus for securing pilot and debarkation ladders to ship deck lashing points for those ladders lacking thimble-arranged lashings.

SUMMARY OF THE INVENTION

In one embodiment, the current invention comprises a multi-strand polyester rope having a thimble eye on one end and a long soft eye on the other end.

In an alternate embodiment, the invention comprises a multi-strand polyester rope having a shackle on one end and a long soft eye on the other end.

In an alternate embodiment, the invention comprises a multi-strand polyester rope with an integrated polyolefin core.

In alternate embodiments, the current invention may comprise sleeves, protective coverings or coatings on wear surfaces where the invention contacts itself or a pilot or debarkation ladder.

DETAILED DESCRIPTION OF THE INVENTION

The accompanying drawings illustrate example embodiments of the invention and its concepts. The drawings are not to scale. The terms and language used herein is for the purpose of describing particular aspects of the invention and is not intended to be limiting of the invention.

Figure 1:
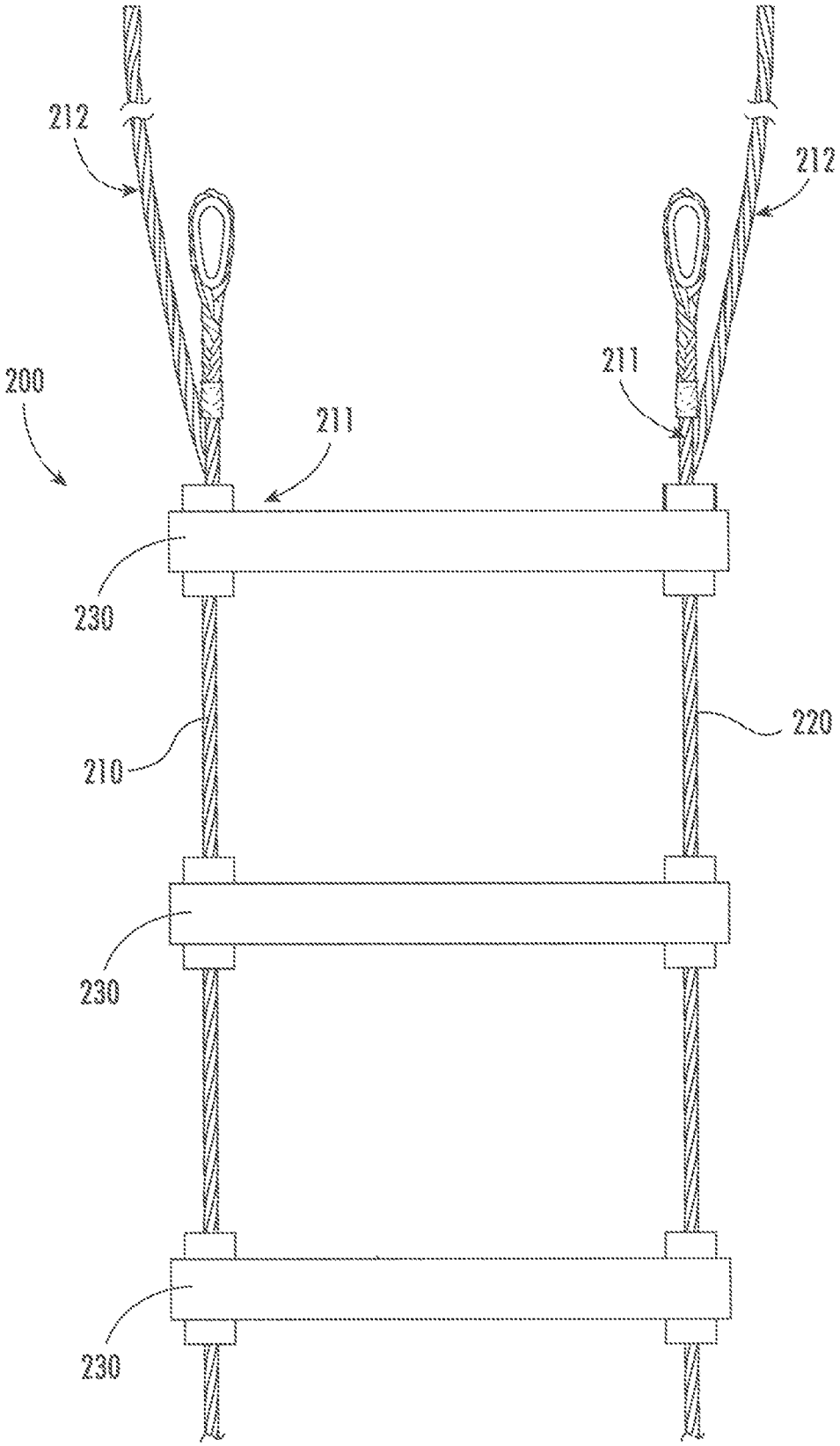
FIG. 1 illustrates a typical pilot ladder with integrated lashings.
Figure 2:
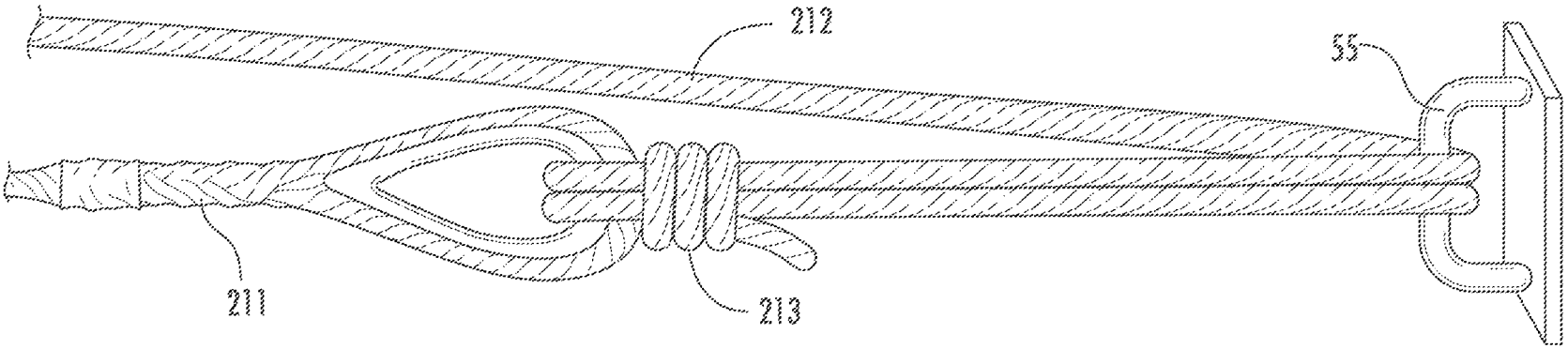
FIG. 2 illustrates the tie-off arrangement of a pilot ladder to a ship deck pad.

As shown in FIG. 1, a typical pilot ladder (200) has tie off lashings (211) and (212) integrated as extensions of the suspension members (210) and (220). While some pilot ladders (200) have four ten-foot extensions (212), two on each side, as lashings, most have one ten foot (212) and one short thimble eye-spliced lashing (211) on each side. In this arrangement, FIG. 2 illustrates properly tied off lashings (211) and (212), when the pilot ladder (200) is of the correct length for the ship. The ten-foot lashing (212) is passed through the ship deck pad (55) and looped back through the short thimble eye-spliced lashing (211), then passed again through the ship deck pad (55) and looped back through the short thimble eye-spliced lashing (211) a second time before being tied off. If the ladder (200) possesses only the ten-foot extensions (212), the tie off must be done using the unspliced lashings (212), without the double loop back arrangement.

In either case, since the lashings (211) and (212) are integrated into a compliantly manufactured pilot ladder (200), the strength of the lashings (211) and (212) can be assured. However, tying large diameter rope such as ¾-inch rope is difficult, and depending upon the skill of the person involved, there could be any number of ways in which the ladder (200) might be tied off. Therefore, there is risk in the tie off being effectively performed.

In addition, if one needed to shorten the ladder (200) for example, the pilot ladder integrated lashings (211) and (212) are of no use to affect a proper tie off to the ship. In this scenario, separate stopper ropes necessary to bridge the gap between the desired ladder suspension point and the ship deck pad (55) must be found. This presents the added risk of the stopper ropes not possessing adequate strength or performance characteristics for safe deployment of the pilot ladder (200) on top of the risk of an ineffective tie off due to inferior skills.

Figure 3:
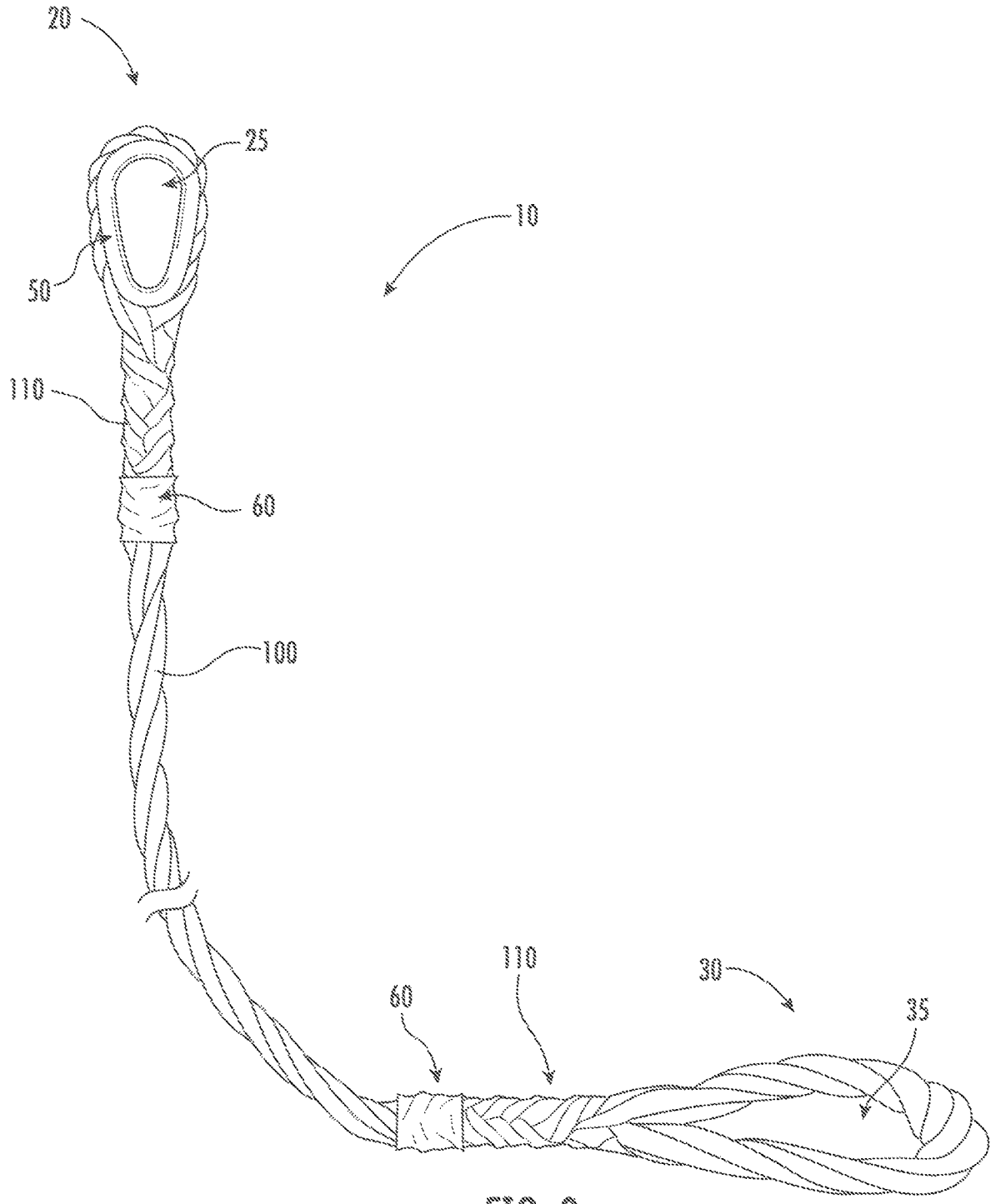
FIG. 3 illustrates an embodiment of the invention.

Referring to FIG. 3, the Knotless Security Device (10) may be comprised of a length of multi-strand rope (100) having a ship end (20) and a ladder end (30). The preferred type of the rope (100) is three strand polyester rope as it has excellent load and wear performance, provides good stretch resistance, which mitigates bounce that contributes to individual instability during use, is soft to the hand yet provides for a firm grip even while wet, and provides for extended lifetime in the open sea environment.

Figure 4A:
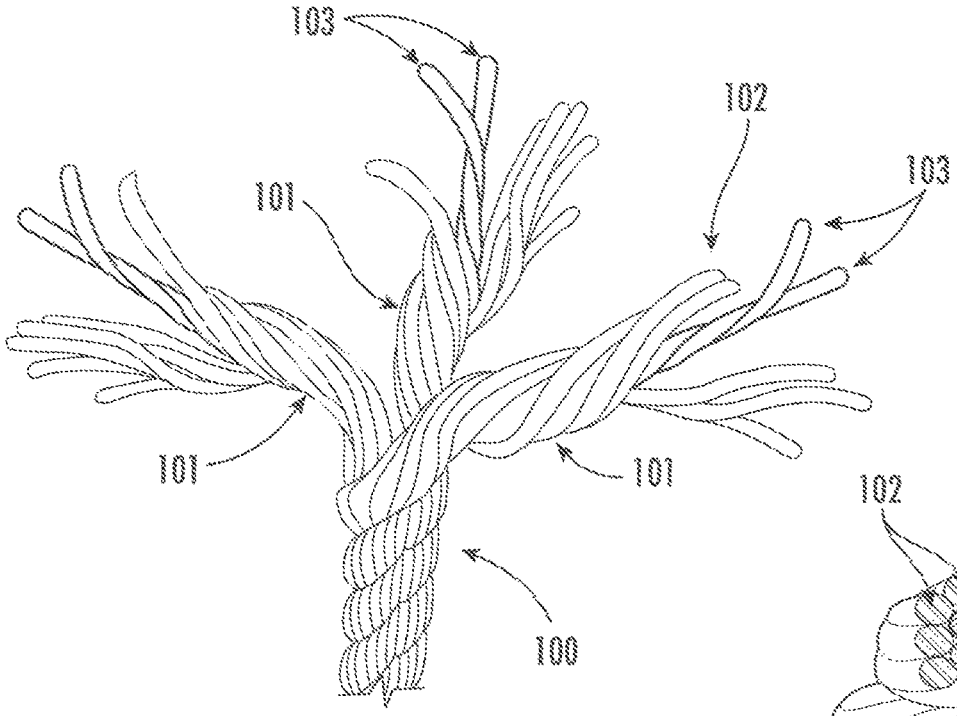
FIGS. 4A and 4B illustrate the preferred embodiment of the rope element.
Figure 4B:
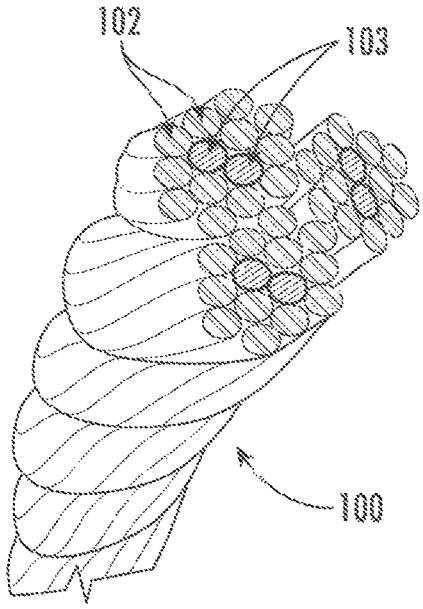

FIG. 4A and FIG. 4B illustrate the structure of the polyester rope as may be used in the instant invention. Commonly available polyester rope is comprised of multiple strands (101), three shown, twisted into a length of rope. Each strand (101) is made of multiple twisted spun polyester threads (102). When used for pilot ladders, a contrasting colored core must be included in the rope. Polypropylene is usually used due to cost and easy availability. However, in one embodiment of the instant invention, at least one polyolefin strand (103), two shown, each constructed of multiple twisted polyolefin threads, is included as a core within each strand (101) to provide superior strength and preserve flexibility, which translates into better stability in ladder tie-off.

In the preferred embodiment of the Knotless Security Device (10), the multi-strand rope (100) includes two polyolefin strands (103) within each polyester strand (101) of the multi-strand rope (100) as depicted in FIGS. 4A and 4B. In this embodiment, the polyolefin-reinforced Knotless Security Device (10) provides pilot ladder-compliant strength that would normally require larger-diametered, less flexible stranded rope. The polyolefin strands (103) may also comprise blended polyolefin strands, including polyethylene, that provide superior performance characteristics when compared to polypropylene.

The ship end (20) of the Knotless Security Device (10) comprises a thimble eye (25). As the primary anchor to the ship, it potentially encounters sharp forces that could tear or otherwise compromise an alternately constructed eyelet. Consequently, the thimble eye (25) requires a rugged, wear and corrosion-resistant eye that is easy to connect with a shackle or similar device to a ship's deck pad (55) or other anchor point, which may consist of moorings, hooks, turnbuckles and other common ship attachment articles. The preferred embodiment of the thimble eye (25) comprises a rope thimble (50) and a multi-tuck splice (110) binding the ship end (20) of the multi-strand rope (100) looped back securely around the thimble (50) to the multi-strand rope (100), thus securing the rope thimble (50) thus comprising the thimble eye (25). The is referred to as a thimble splice. In the preferred embodiment, the rope thimble (50) is comprised of 316 stainless steel in order to withstand the corrosive environment of the open sea.

Figure 5:
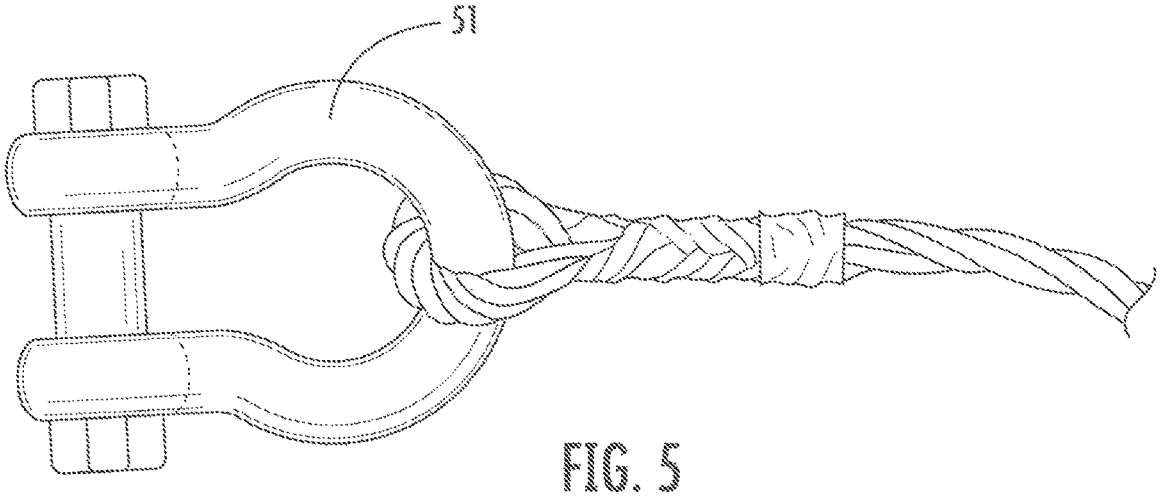
FIG. 5 illustrates an alternate embodiment of the invention.

In an alternate embodiment the ship end (20) of the Knotless Security Device (10) comprises a shackle (51), see FIG. 5. The advantage of this arrangement is the complete elimination of any further required intervening mechanical devices between the pilot ladder (200) and the ship deck pad (55) when the invention is used.

Figure 6:
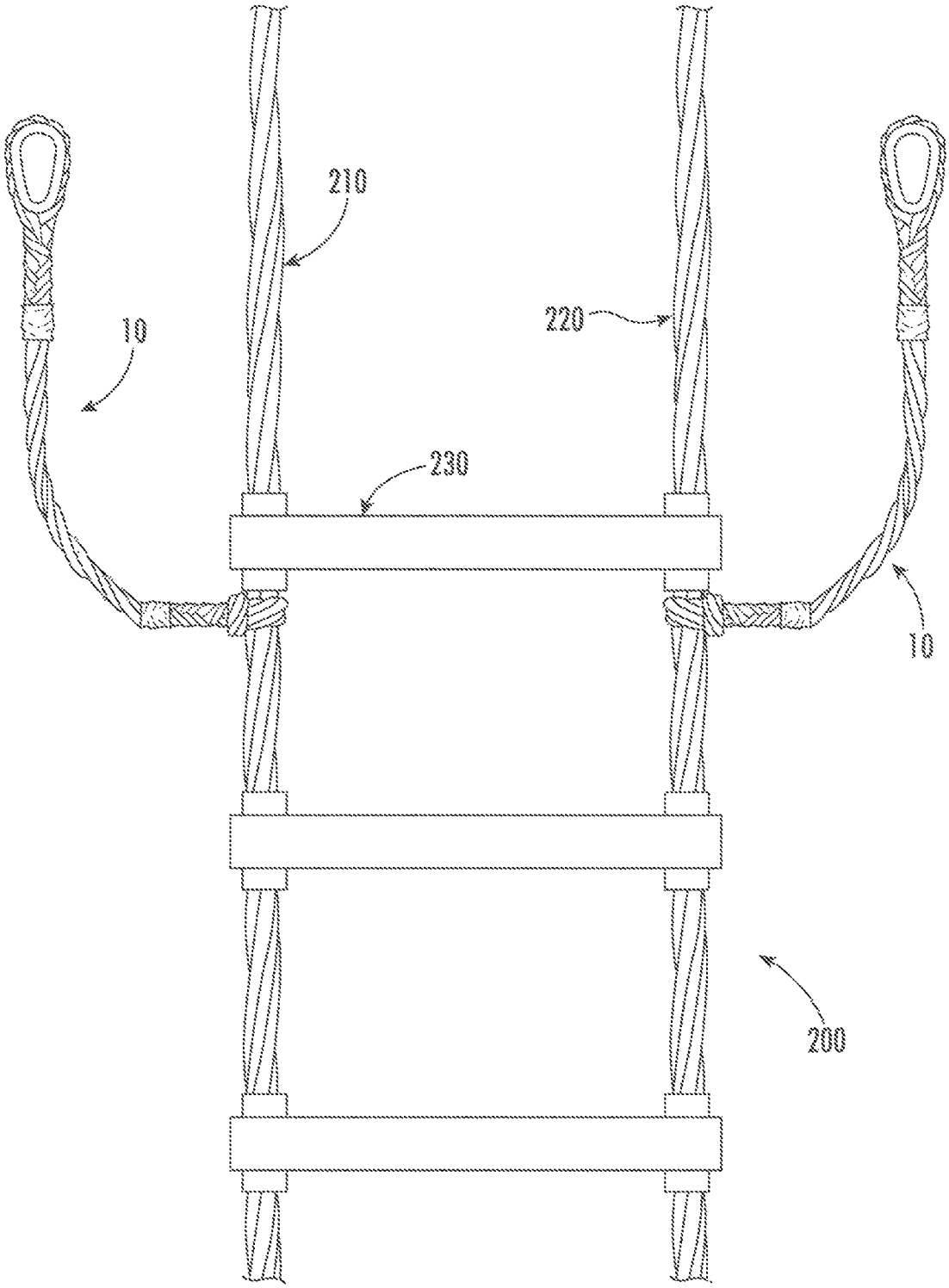
FIG. 6 illustrates pilot ladder suspension members secured by the invention.

The preferred embodiment of the ladder end (30) comprises a long soft eye (35) that is capable of encircling a pilot ladder side rope (210) or (220), as seen in FIG 6. The preferred embodiment of the long soft eye (35) comprises a multi-tuck splice (110) binding the ladder end (30) of the multi-strand rope (100) looped back to the multi-strand rope (100). This is referred to as an eye splice. The ladder end (30) of the Knotless Security Device (10) serves as an easily assembled secure tether-type of arrangement that is flexible at the point of attachment and does not impart excessive wear or concentrated loads on the ladder (200) or any ladder elements. Flexibility is important as not all pilot ladders share the same construction. The Knotless Security Device (10) is configured such that it may easily capture virtually any pilot ladder (200) at any height without disassembly, modification or physically compromising the ladder.

The preferred embodiment of the multi-tuck splices (110) on both the ship end (20) and the ladder end (30) of the Knotless Security Device (10) comprises five tucks and a length of shrink-wrap tube (60) securely surrounding at least a portion of the tucks of the multi-tuck splices (110) beginning at the end of the tucks in order to contain the loose ends of the rope strands over the course of usage. FIG. 3 depicts typical eye splice arrangements (110), which are used in the invention.

Figure 7:
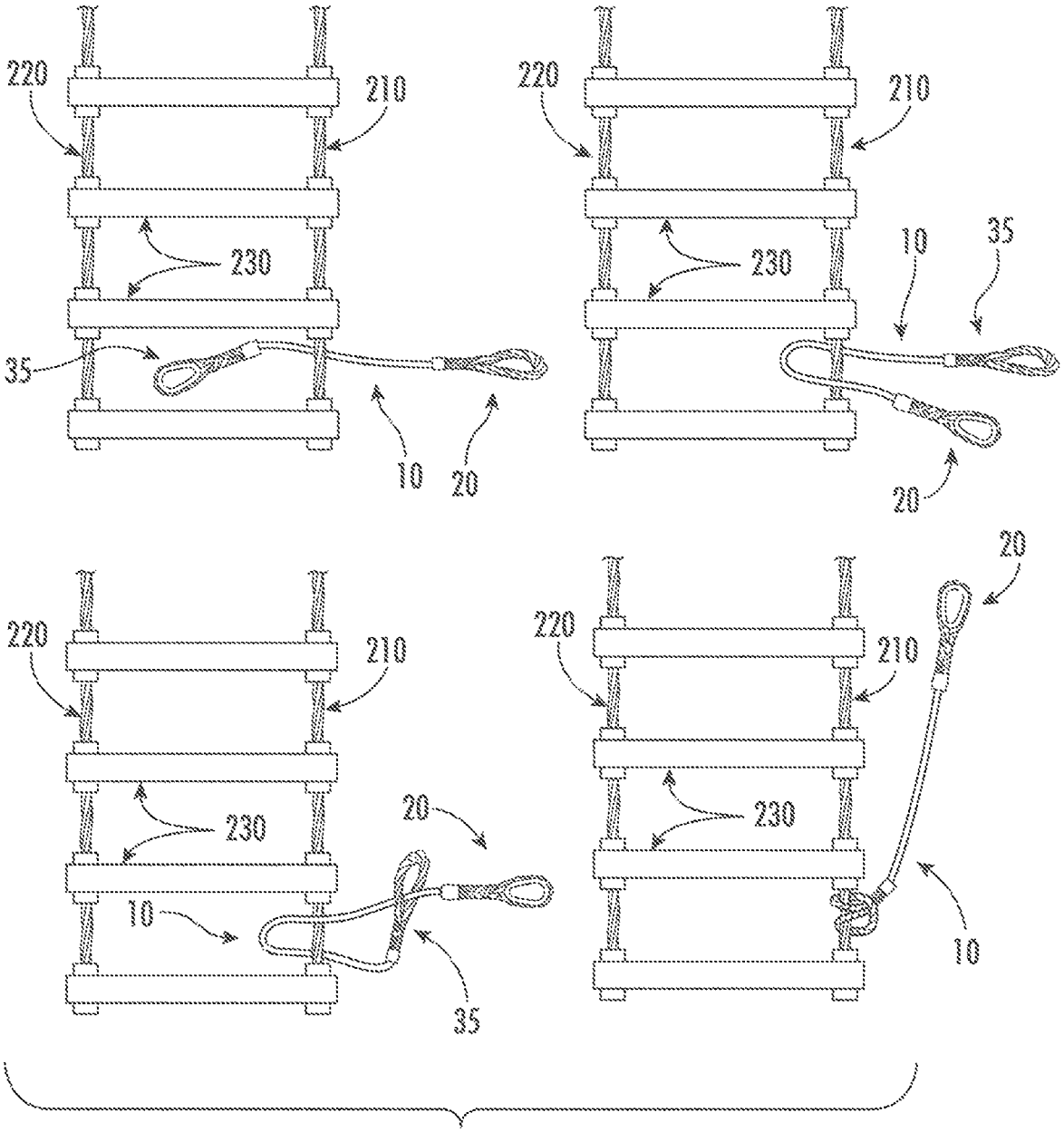
FIG. 7 illustrates steps in deployment of the invention.

In the best mode, referencing FIG. 7, a user secures a marine ladder to a ship by using at least two Knotless Security Devices (10). In STEP #1 and STEP #2 the user starts by encircling one of the two marine ladder's side ropes (210) below any step (230) of the marine ladder (200) with a first Knotless Security Device (10), then in STEP #3 and STEP #4 inserts the ship end (20) of the first Knotless Security Device (10) through the long soft eye (35) of the first Knotless Security Device (10) and pulls to tighten the long soft eye (35) around the marine ladder side rope (210), then secures the ship end (20) of the first Knotless Security Device (10) to the ship. Similarly, the user then encircles the second of the two marine ladder's side rope (220) below the same step (230) of the marine ladder (200) with a second Knotless Security Device (10), then inserts the ship end (20) of the second Knotless Security Device (10) through the long soft eye (35) of the second Knotless Security Device (10), and then secures the ship end (20) of the second Knotless Security Device (10) to the ship.

The user easily secures the ship ends (20) of the Knotless Security Devices (10) to the ship's attachment points with a simple shackle or similar device commonly found on ships, thus not requiring any knots to be tied.

In the alternate embodiment where the ship end (20) of the Knotless Security Device (10) comprises a shackle (51) as shown in FIG. 5, the user easily secures the ship ends (20) of the Knotless Security Devices (10) directly to the ship's attachment points, thus not requiring any knots to be tied or any compliant mechanical fittings to be located.

It will readily be apparent to those skilled in the art that other applications are possible for the present invention, and while the embodiments described herein are illustrative of the invention, other modes of implementation are both within the spirit and scope of the invention.

What is claimed is:

1. A method for securing a marine ladder to a ship using at least two Knotless Security Devices, the Knotless Security Device comprising:

a length of multi-strand polyester rope having a ship end and a ladder end, the multistrand polyester rope comprising at least one polyolefin strand core, the ship end comprising a thimble eye, and the ladder end comprising a long soft eye, the method comprising:

encircling one of the two marine ladder's side ropes below a step of the marine ladder with a first Knotless Security Device, inserting the ship end of the first Knotless Security Device through the long soft eye of the ladder end of the first Knotless Security Device, securing the ship end of the first Knotless Security Device to the ship, encircling the second of the two marine ladder's side ropes below the step of the marine ladder with a second Knotless Security Device, inserting the ship end of the second Knotless Security Device through the long soft eye of the ladder end of the second Knotless Security Device, and securing the ship end of the second Knotless Security Device to the ship.

2. The method for securing a marine ladder to a ship using at least two Knotless Security Devices of claim 1 wherein securing the ship ends of the first and second Knotless Security Devices to the ship comprise:

locating and coupling a first and a second shackle through the thimble eyes of the first and second Knotless Security Devices respectively and to the ship respectively.

* * * * *